US007032692B2

(12) United States Patent
Nozaki et al.

(10) Patent No.: US 7,032,692 B2
(45) Date of Patent: Apr. 25, 2006

(54) DRILLING DEVICE FOR EARTH DRILL

(75) Inventors: Satoshi Nozaki, Ishioka (JP); Takashi Abe, Sakai (JP); Osamu Arai, Takasago (JP); Kazuhiro Arai, Kobe (JP)

(73) Assignee: Hitachi Construction Co., Ltd., Tokyo (JP)

( * ) Notice: Subject to any disclaimer, the term of this patent is extended or adjusted under 35 U.S.C. 154(b) by 144 days.

(21) Appl. No.: 10/481,010

(22) PCT Filed: Apr. 25, 2002

(86) PCT No.: PCT/JP02/04143

§ 371 (c)(1),
(2), (4) Date: Dec. 17, 2003

(87) PCT Pub. No.: WO03/091532

PCT Pub. Date: Nov. 6, 2003

(65) Prior Publication Data

US 2004/0168831 A1 Sep. 2, 2004

(51) Int. Cl.
*E21B 27/00* (2006.01)
*E21B 11/04* (2006.01)

(52) U.S. Cl. ..... 175/161; 175/316

(58) Field of Classification Search ..... 175/5, 175/58, 161, 316; 166/250.16, 264
See application file for complete search history.

(56) References Cited

U.S. PATENT DOCUMENTS 2,122,584 A * 7/1938 Peck ..... 175/173
3,194,329 A * 7/1965 Wallers ..... 175/316
4,860,837 A * 8/1989 Robert ..... 175/113
4,971,163 A * 11/1990 Ohashi et al. ..... 175/265
5,067,570 A * 11/1991 Gilcrease ..... 175/209
5,431,238 A * 7/1995 Trevisani ..... 175/308

FOREIGN PATENT DOCUMENTS

JP 06002475 A * 1/1994
JP 11-141261 5/1999
JP 2001-90465 4/2001
JP 2001-152776 6/2001
JP 2001-323768 11/2001
JP 2003090192 A * 3/2003
JP 2004060186 A * 2/2004

* cited by examiner

*Primary Examiner*—David Bagnell
*Assistant Examiner*—Shane Bomar

(74) *Attorney, Agent, or Firm*—Mattingly, Stanger, Malur & Brundidge, P.C.

(57) ABSTRACT

Locking elements 3*d* and 3*j* are provided at an inner member 3 connected to a kelly bar 1, and a locking element bearing plate 6*f* is provided at an outer member 6. The outer member 6 includes a cylindrical bucket 7 and a grab bucket 8 housed inside the cylindrical bucket 7. When an excavating tool 2 is in its most contracted state, the inner member 3 is rotated forward to lock the locking elements 3*d* and 3*j* at the locking element bearing plate 6*f*, thereby disallowing relative vertical movement of the inner member 3 and the outer member 6. As the excavating tool is rotated by applying a force to the kelly bar 1 along the lifting direction in this state, an excavating operation can be executed while applying a load smaller than the load of the excavating tool 2.

4 Claims, 14 Drawing Sheets

DRILLING DEVICE FOR EARTH DRILL

TECHNICAL FIELD

The present invention relates to an excavating tool mounted at the kelly bar of an earth drill to excavate cobblestones, boulders, concrete slab or the like.

BACKGROUND ART

An earth drill, which excavates material by taking in excavated soil into a bucket while excavating the bottom of a bore hole with a cutter provided at a conical bottom cover, is normally ideal for an excavating operation on a soil stratum that can be represented with an N value. However, it is not suited for so-called barrier excavation including excavation of stones such as cobblestones and boulders that are too large to fit into the drilling bucket and excavation of a concrete slab. If the cutter strikes such a layer during an excavating operation, special measures must be taken by, for instance, removing the cobblestones with a hammer grab bucket mounted at a separate crane or using an all casing machine.

The inventor of the present invention et al. proposed in Japanese Unexamined Patent Publication No. H 11-141261 a means for solving the problem described above, achieved by mounting a detachable cylindrical bucket at the kelly bar instead of the drilling bucket for the earth drill having the bottom cover and by also providing a auger type excavating tool that forms a small hole in the vicinity of its circular drilling groove to allow excavated material to be drawn out through the hole.

However, there is a problem with an earth drill that utilizes a cylindrical bucket as disclosed in Japanese Unexamined Patent Publication No. H 11-141261 in that a separate lifting means is required to lift the excavated round slab, rocks and the like.

Accordingly, the inventor of the present invention et al. proposed an excavating tool for an earth drill in Japanese Unexamined Patent Publication No. 2001-90465, which allows excavated material to be lifted to the ground level during a barrier excavating operation of slab, cobblestones, boulders or the like executed with the earth drill.

The excavating tool disclosed in the publication described above comprises an inner member having an upper end thereof connected to the kelly bar, an outer member and a second member provided between the inner member and the outer member. These members are combined so as to allow them to move up/down relative to one another. In addition, a cylindrical bracket having an cutting teeth at the lower end thereof and an open bottom is mounted at the outer member. At the outer member, a grab bucket housed inside the cylindrical bucket and constituted of a pair of jaws which grab objects excavated with the cylindrical bucket is provided as well.

The lower end of the second member is linked to the jaws at the grab bucket so as to open and close the grab bucket. The excavating tool adopts a structure that closes the grab bucket as the second member moves upward relative to the outer member and opens the grab bucket as the second member moves downward relative to the outer member. Namely, the inner member and the second member are connected with each other through a first hydraulic cylinder and second hydraulic cylinders provided between the second member and the grab bucket. Pressure is generated as the kelly bar is lifted and the first hydraulic cylinder consequently extends, which communicates the pressure to the second hydraulic cylinders to extend the second hydraulic cylinder. This lifts the second member relative to the outer member, and thus, the grab bucket mounted at the outer member closes to trap soil.

The excavating tool adopts a structure that automatically releases the binds among the inner member, the second member and the outer member achieved with cotters to allow them to extend as the members held in a most contained state achieved with the cotters are lowered to the bottom of the bore hole. Then, as the kelly bar is rotated, the cylindrical bucket and the grab bucket are caused to rotate together with the inner member, the second member and the outer member to cut into the earth. When the kelly bar is lifted after the earth is cut to a predetermined depth, the inner member is lifted together with the kelly bar while the outer member remains at the bottom of the bore hole due to the dead weight of the cylindrical bucket, the grab bucket and the like. As a result, the grab bucket, with its jaws linked to the second member, closes through the operation described above to take in the soil to be excavated. After the grab bucket is closed, the outer member is lifted to the ground level together with the cylindrical bucket and the grab bucket. As the cylindrical bucket is set on the ground and the kelly bar is lowered, the first hydraulic cylinder contracts, the pressure generated in the pressure oil through the contraction of the first hydraulic cylinder causes the second hydraulic cylinders to contract as well and the second member is lowered as a result, thereby allowing the grab bucket to open to discharge the excavated soil onto the ground.

DISCLOSURE OF THE INVENTION

The excavating tool for an earth drill disclosed in Japanese Unexamined Patent Publication No. 2001-90465 described above is yet to address the following problems.

(1) This excavating tool executes excavation while a load representing the sum of the dead weight of the excavating tool and the pressing force of the kelly bar achieved by setting the cylindrical bucket on the excavating surface in a state in which the grab bucket is open and then by pushing down the kelly bar. However, the level of the load that can be applied to the excavating surface while the grab bucket is open becomes equal to or greater than the load of the excavating tool and thus, the pressing force constituted of a load less than that of the excavating tool cannot be applied. To explain this in more specific terms, as the excavating tool is lowered to the bottom of the bore hole, the cotter mounted at the outer member becomes automatically disengaged from the hole of the second member and the hole of the inner member, and if the kelly bar is lifted in this state, the inner member becomes also lifted relative to the second member and the second member, too, becomes lifted relative to the outer member, thereby closing the grab bucket.

For this reason, the excavating operation may become difficult if an earth drill with a small drive force is utilized to rotate a cylindrical bucket with a large diameter, since a large excavating torque is required due to the increase in the resistance at the excavating surface, the dead weight of the large excavating tool and the like.

(2) In addition, since the pressing force cannot be controlled so as not to exceed the dead weight of the excavating tool, the cutter mounted at the lower end of the outer member may become damaged readily.

(3) Japanese Unexamined Patent Publication No. 2001-90465 described above discloses in one of the embodiments a structure detailed below. Namely, in a state in which the excavating tool is at its most contracted, a projection formed at the outer circumference of the inner member becomes engaged at a notch formed at the sleeve of the second member, thereby preventing the relative vertical movement among the members so as to allow the grab bucket to be lifted while it is open. However, there is a problem with this structure in that if there is a relatively large underground obstacle such as a rock, the underground obstacle cannot be removed by closing the jaws to a certain extent and rotating the underground obstacle grabbed with the jaws.

An object of the present invention is to provide an excavating tool for an earth drill having a cylindrical bucket with a grab bucket provided therein which is closed by using the force with which the kelly bar is lifted, which allows an excavating operation to be executed while a load smaller than the load of the excavating tool is applied, thereby enabling an earth drill with a small drive force to excavate material with a relatively large excavating tool and makes it possible to remove underground obstacles by rotating the grab bucket in a state in which the grab bucket is partially closed.

(1) In order to achieve the object described above, the excavating tool for an earth drill according to the present invention comprises a tubular inner member linked to the kelly bar, a tubular second member fitted on the outer side of the inner member so as to be allowed to move up/down freely and an outer member should on the outer side of the second member so as to be allowed to move up/down. A cylindrical bucket and a grab bucket housed inside the cylindrical bucket are mounted at the outer member, a first hydraulic cylinder is mounted between the inner member and the second member, second hydraulic cylinders which are caused to extend or contract by pressure oil from the first hydraulic cylinder are mounted between the second member and the jaws of the grab bucket, and a locking mechanism is provided between the inner member and the outer member. The locking mechanism is constituted of a locking element provided at the outer circumference of the inner member and a locking element bearing plate provided at the top of the outer member, the locking element is allowed to pass through the locking element bearing plate when the inner member and the outer member achieve a specific relative rotational angle, and the locking element is locked at the locking element bearing plate to disallow relative vertical movement of the inner member and the outer member as the inner member is rotated along the forward direction when the excavating tool is in the most contracted state. A projection provided at the outer circumference of the inner member is fitted in guide rails provided along the longitudinal direction at the inner circumference of the second member so as to be allowed to move up/down freely, and the inner member is allowed to rotate forward over a predetermined range relative to the second member when the excavating tool is in the most contracted state.

Since the locking mechanism that disallows the relative vertical movement of the inner member and the outer member when the excavating tool is in the most contracted state is provided as described above, an excavating operation can be executed while a load smaller than the load of the excavating tool is applied by the cylindrical bucket to the excavating surface by applying a certain level of force to the kelly bar along the lifting direction to rotate the kelly bar along the forward rotating direction, i.e., along the excavating direction. As a result, even when excavating material by using a small earth drill to rotationally drive a relatively large excavating tool, a sufficient drive force is assured for the excavating operation. In addition, the excavating operation can be executed in an optimal manner with a small pressing force as called for in specific individual situations.

Furthermore, even if there is an excessively large lifting reactive force when the grab bucket is operated along the closing direction at the bottom of the bore hole, the grab bucket can still be lifted in an open state by lowering the inner member again, rotating the kelly bar by a predetermined angle along the forward direction and locking the locking element at the locking element bearing plate. Thus, the risk of not being able to lift the excavating tool out of the ground under such circumstances is eliminated.

Since the second member and the outer member can be caused to rotate reciprocally by interlocking with the rotation of the inner member as the kelly bar rotates while the inner member is in a state in which it is lifted to a certain extent relative to the second member and the outer member, i.e., in a state in which the grab bucket is in the process of becoming closed, an underground obstacle clamped at the grab bucket can be rotated to more easily remove the underground obstacle compared to the related art.

(2) It is desirable that excavating tool for an earth drill according to the present invention include the locking element at the top of the inner member formed as a cylindrical portion, that the locking element include a projecting portion projecting outward as an integrated part of a disk having a diameter larger than the diameter of the cylindrical portion and that the locking element bearing plate be constituted of a plate having a locking element passing portion which is substantially isomorphic with the locking element and slightly larger than the locking element.

By constituting the locking element and the locking element bearing plate with plates larger than the cylindrical portion as described above, the locking element and the locking element bearing plate are placed in contact with each other over a large area when they are in a locked state so as to withstand a large load.

(3) In addition, it is desirable that the inner member in the excavating tool for an earth drill according to the present invention include a cylindrical portion the outer circumferential surface of which comes in contact with the guide rails located at a corner of an angular tube portion within the second member and bracing rails provided at the inner surfaces of the angular tube portion.

By placing the outer circumferential surface of the cylindrical inner member in contact with the guide rails and the bracing rails as described above, the inner member does not become off-centered relative to the second member or the outer member so as to ensure that the locking element is allowed to pass through the locking element passing portion of the locking element bearing plate smoothly.

(4) It is also desirable that the excavating tool for an earth drill according to the present invention further include third hydraulic cylinders that match the volumes of supply/discharge oil quantities between the first hydraulic cylinder and the second hydraulic cylinders. By providing the third hydraulic cylinders as a dummy cylinders, it becomes unnecessary to mount an accumulator and the like at the excavating tool and, at the same time, a structure having the bottom chambers of the hydraulic cylinders turned upward can be adopted. As a result, the closed hydraulic circuit can be formed by using hydraulic piping constituted of steel instead of hydraulic hose.

BEST MODE FOR CARRYING OUT THE INVENTION

Figure 1:
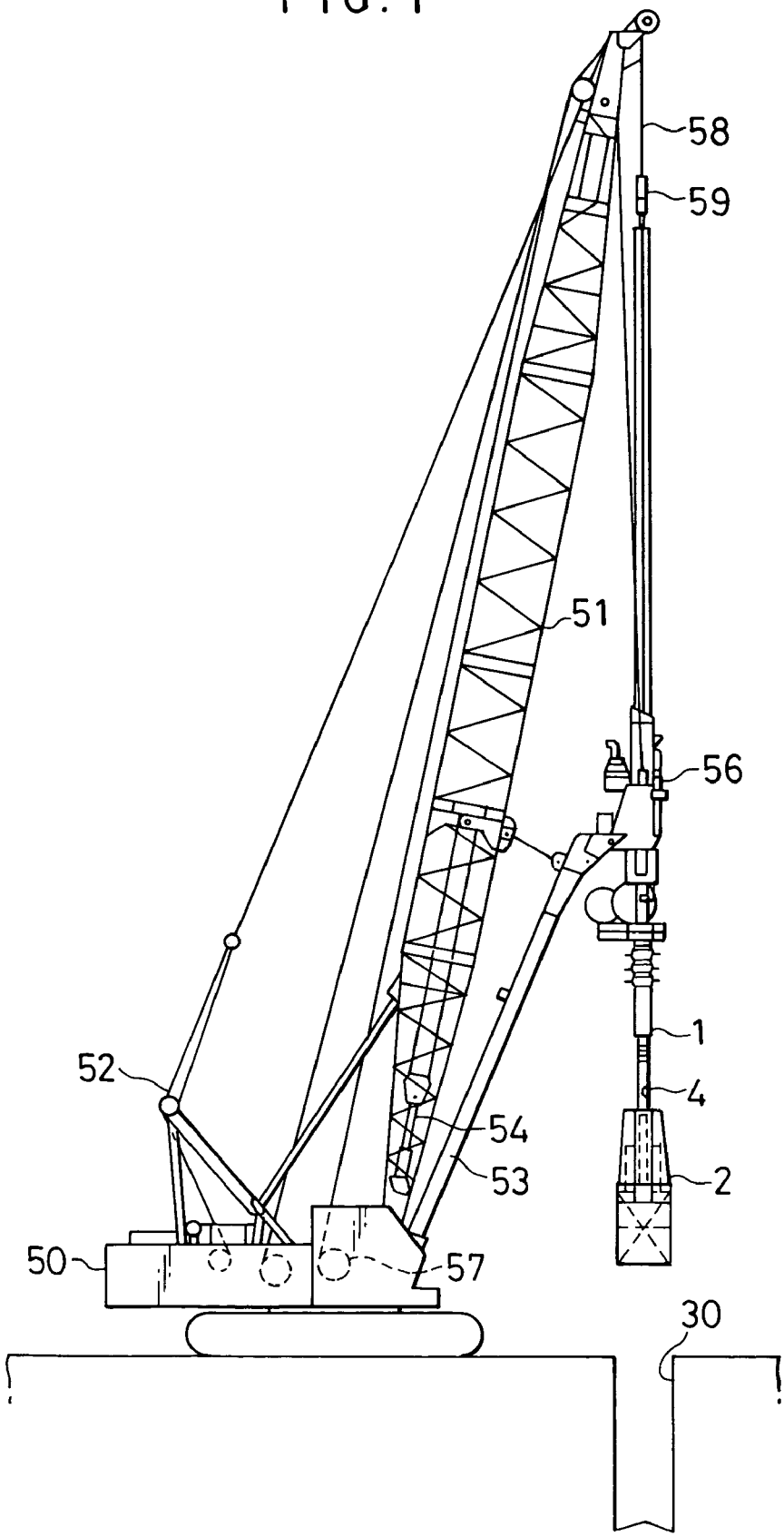
FIG. 1 is a side elevation of an earth drill having an excavating tool as achieved in an embodiment of the present invention.

FIG. 1 is a side elevation of an earth drill having the excavating tool according to the present invention as achieved in an embodiment. As shown in FIG. 1, a boom 51 is mounted at an earth drill main unit 50 so as to be freely raised or lowered with hoisting gear 52 and a front frame 53 is mounted at the front of the earth drill main unit 50 so as to be freely raised and lowered with the hoisting gear 54. At the top of the front frame 53, a kelly drive device 56 that rotates a kelly bar 1 inserted through the kelly drive device 56 so as to allow the kelly bar to move up/down is installed. The kelly bar 1 is supported via a swivel joint 59 with a hoisting rope 58 which is taken up and fed by a hoist winch 57 mounted at the earth drill main unit 50. The kelly bar 1 is constituted by fitting together three or more pipes of various sizes so as to allow them to move up/down but disallow their rotation relative to each other, with a drilling bucket linked to the innermost pipe. Reference numeral 2 indicates the excavating tool according to the present invention, which is detachably mounted at the kelly bar 1 for barrier excavation instead of the drilling bucket that is normally mounted at the kelly bar 1.

Figure 2:
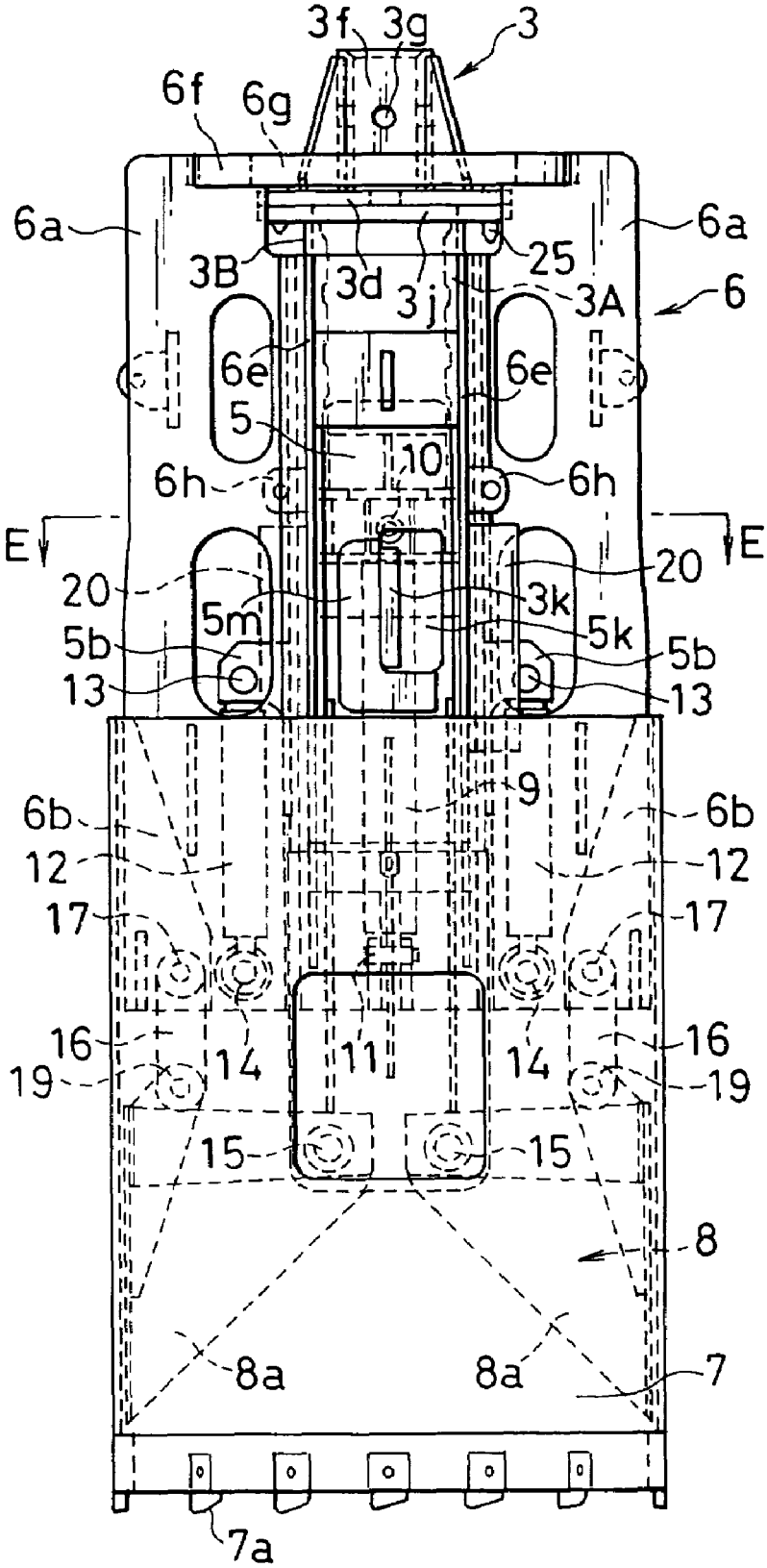
FIG. 2 is a side elevation of the excavating tool in FIG. 1 in its most contracted state.
Figure 3:
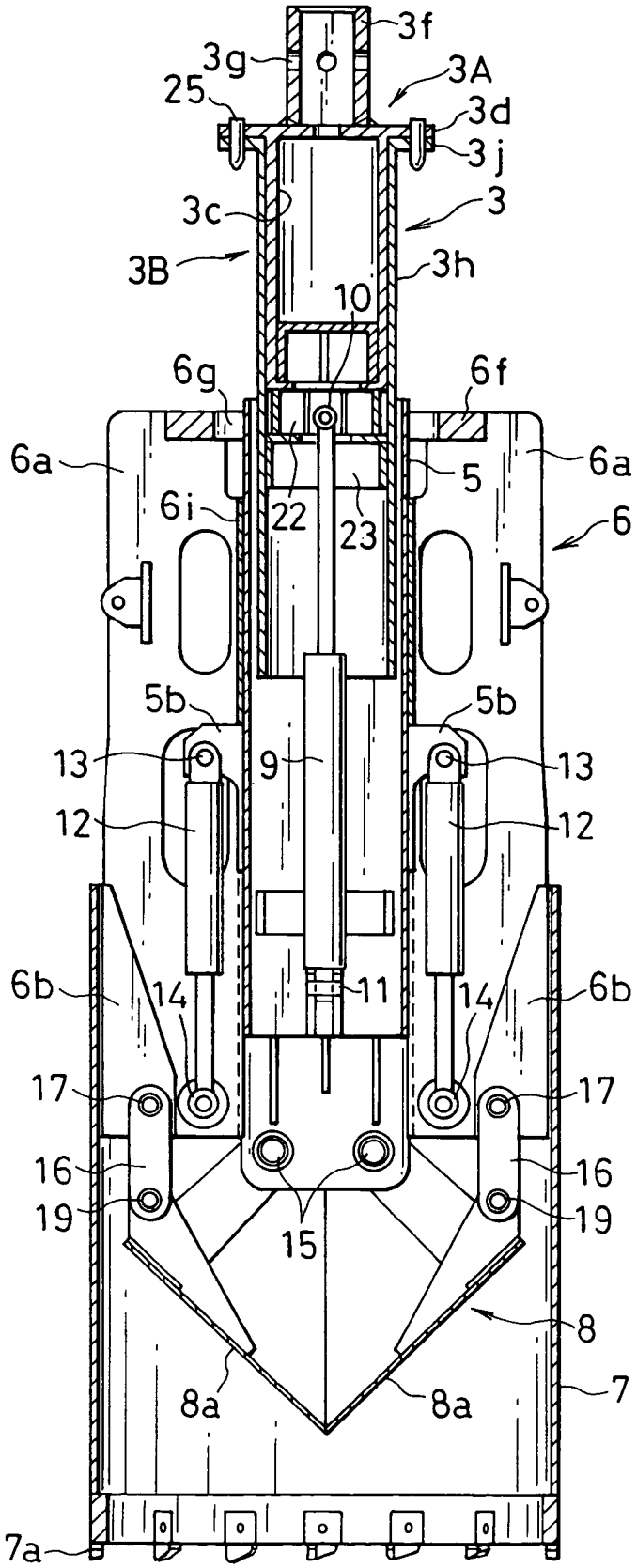
FIG. 3 is a cross-section of a side elevation of the excavating tool in FIG. 2 in its most extended state.
Figure 4:
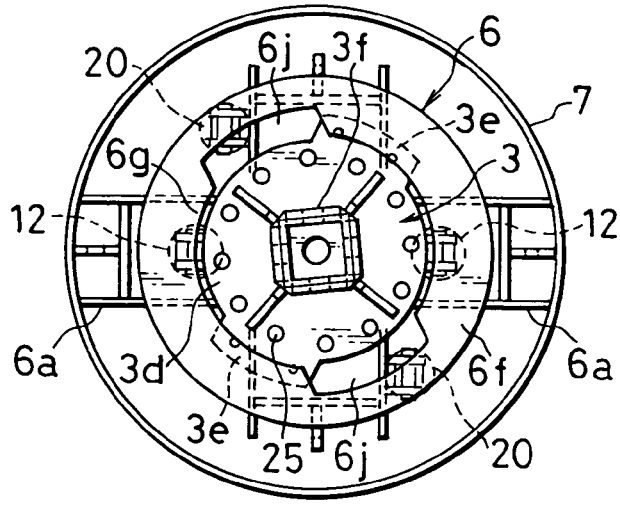
FIG. 4 is a plan view of the top of the excavating tool in FIG. 2.
Figure 5:
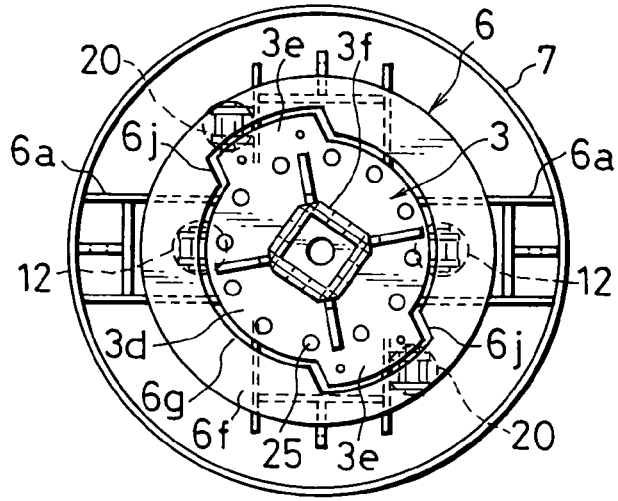
FIG. 5 is a plan view of the top of the excavating tool in FIG. 3.
Figure 6:
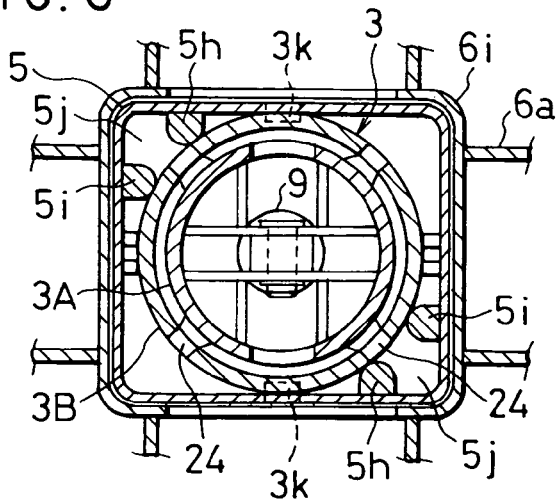
FIG. 6 is a sectional view taken along E—E in FIG. 2.
Figure 7:
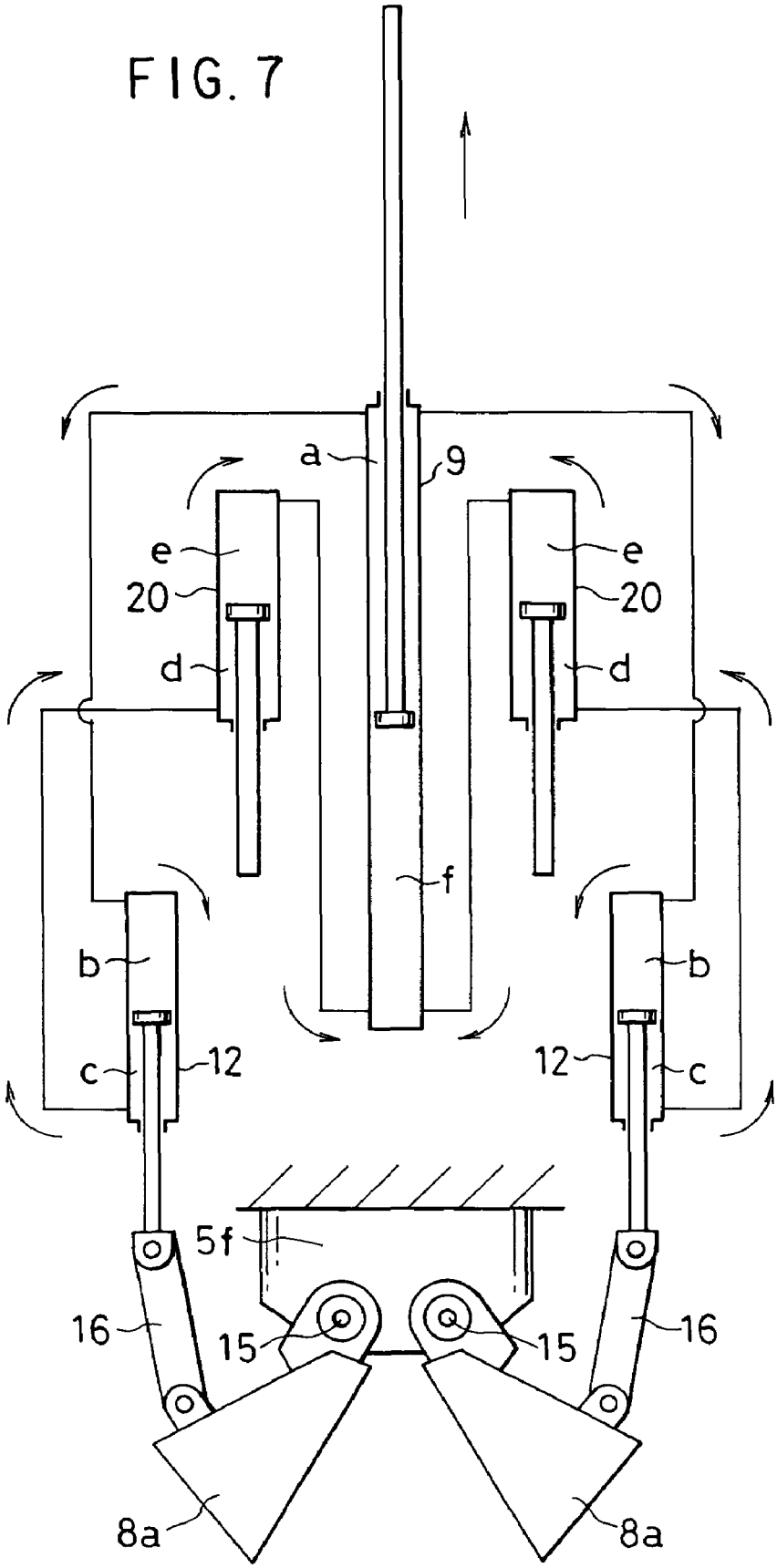
FIG. 7 shows the structures of the hydraulic cylinders constituting an grab drive device for the grab bucket achieved in the embodiment.

FIG. 2 is a side elevation of the excavating tool 2 in its most contracted state, i.e., in a state in which the grab bucket is open, FIG. 3 is a cross section of a side elevation of the excavating tool 2 in its most extended state, i.e., in a state in which the grab bucket is closed, FIGS. 4 and 5 are plan views of the top sides of FIGS. 2 and 3 respectively, FIG. 6 is a sectional view taken along E—E in FIG. 2 and FIG. 7 shows the structure of the hydraulic cylinders constituting an grab drive device for the grab bucket.

In FIGS. 2 to 7, reference numeral 3 indicates an inner member which is detachably connected to the kelly bar 1 with a pin 4 (see FIG. 1), reference numeral 5 indicates a second member which is fitted on the outer side of the inner member 3 so as to be allowed to move up/down freely and reference numeral 6 indicates an outer member which is fitted on the outer side of the second member so as to be allowed to move up/down freely. A cylindrical bucket 7 is mounted at the outer member 6 and the grab bucket 8 is mounted inside the cylindrical bucket 7.

Figure 8:
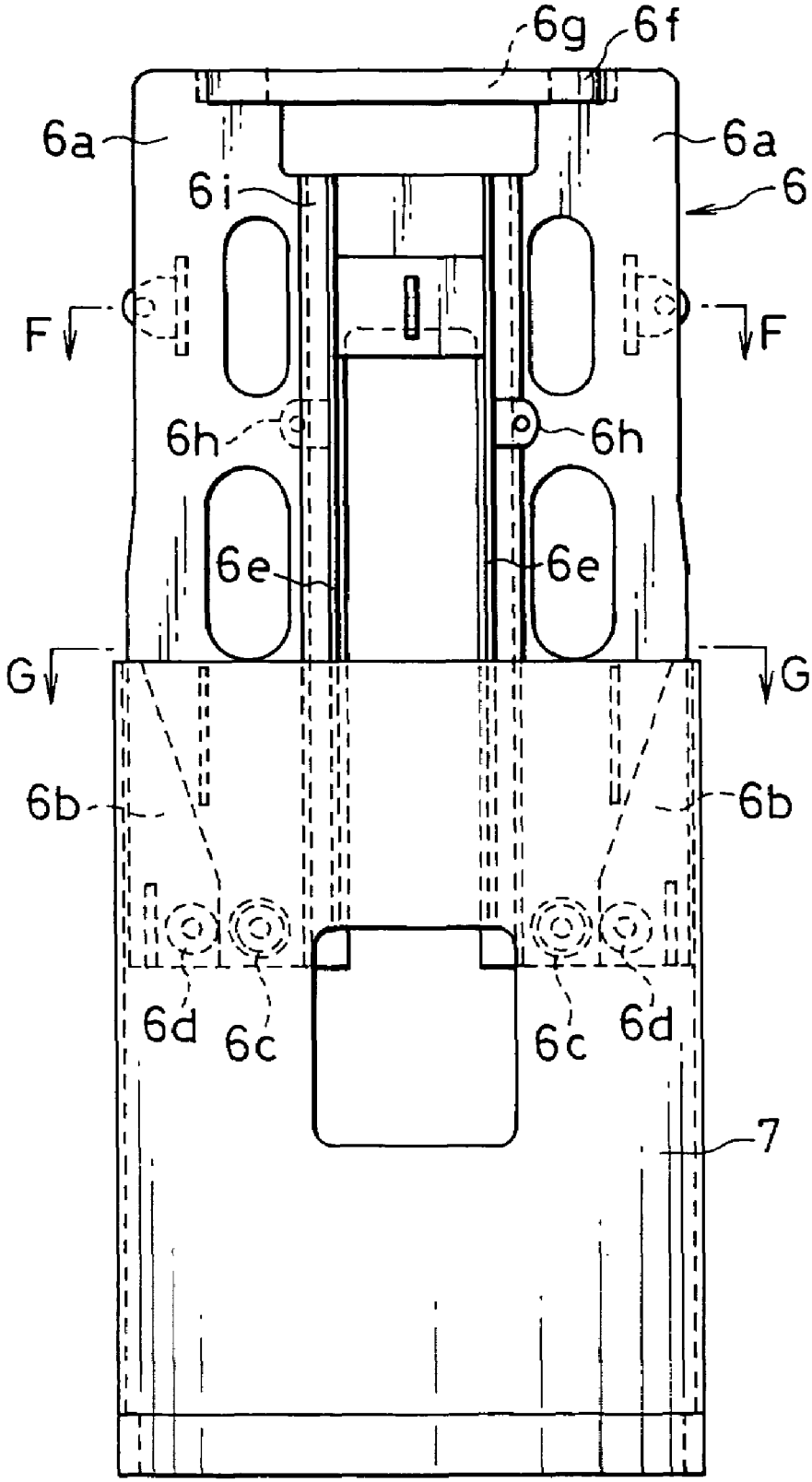
FIG. 8 is a side elevation of the outer member achieved in the embodiment.
Figure 9:
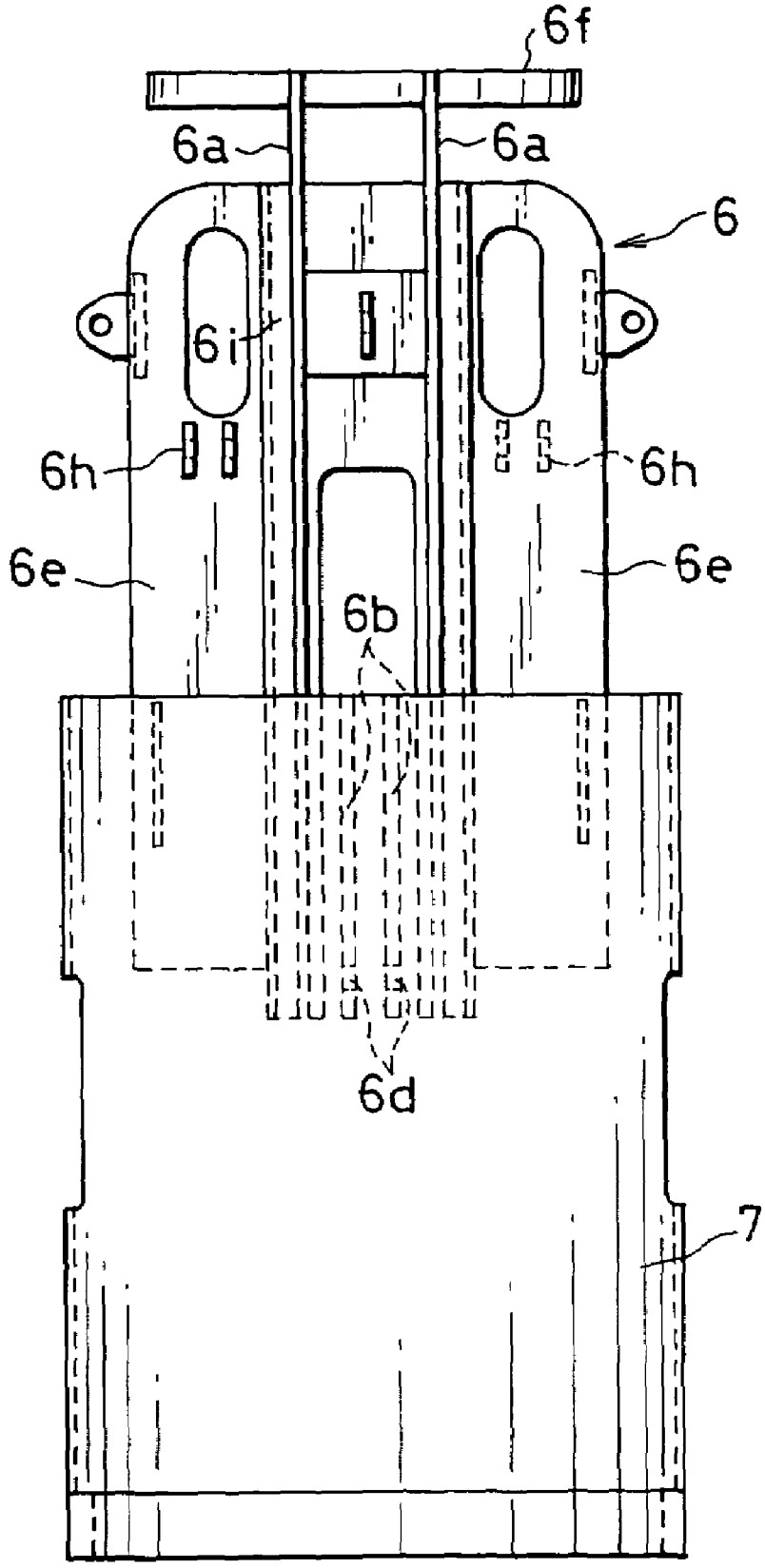
FIG. 9 is a front view of the outer member in FIG. 8.
Figure 10:
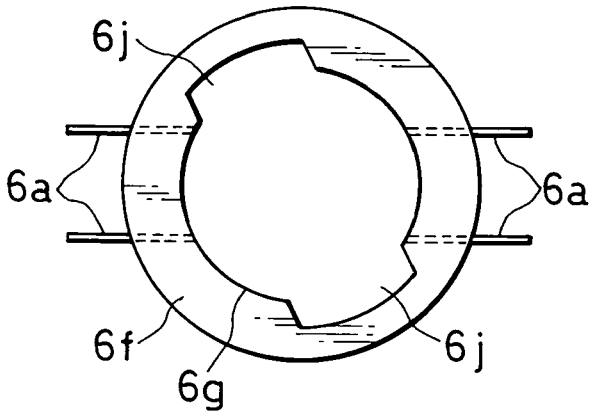
FIG. 10 is a plan view of the top of the outer member achieved in the embodiment.
Figure 11:
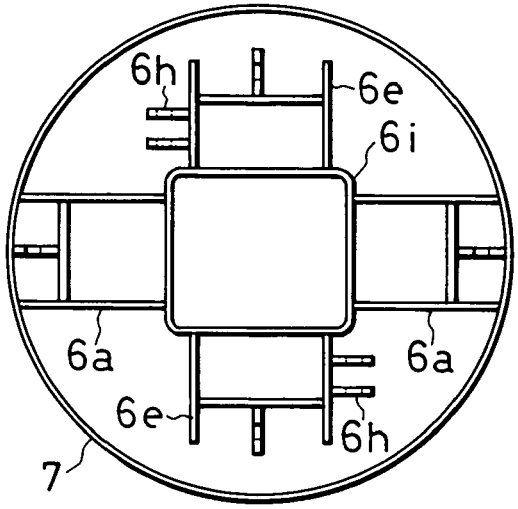
FIGS. 11 and 12 present sectional views taken along F—F and G—G respectively in FIG. 8.
Figure 12:
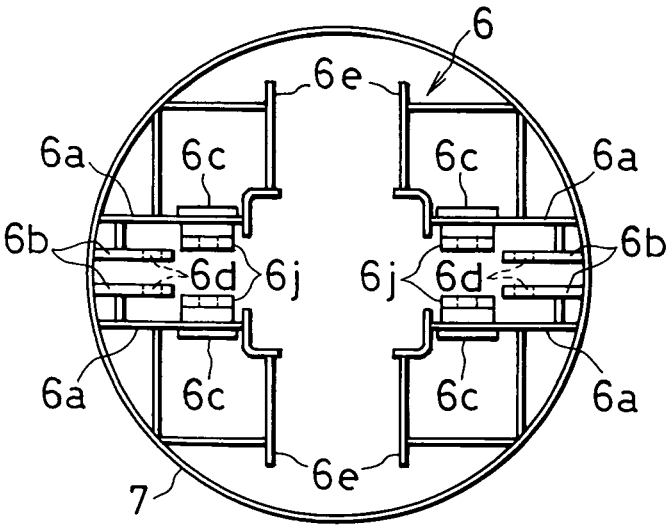

FIG. 8 is a side elevation of the outer member 6, FIG. 9 is a front view of the outer member 6, FIG. 10 is a plan view of the top side of the outer member 6 and FIGS. 11 and 12 are sectional views taken along F—F and G—G in FIG. 8 respectively.

As shown in FIGS. 8, 9 and 11, the outer member 6 includes an angular tube portion **6*i* having part of its side surface removed and located at the center of the outer member 6. At the front and rear surfaces of the angular cube portion 6*i*, mounting plates 6*a* each constituted of a parallel plate are bonded and the cylindrical bucket 7 is bonded to the lower portions of the mounting plates 6*a*. As shown in FIGS. 2 and 3, a plurality of cutting teeth 7*a* are disposed along the circumferential direction at the lower portion of the cylindrical bucket 7**.

As shown in FIGS. 2 and 3, a first hydraulic cylinder 9 is housed inside the inner member 3, the piston rod of the first hydraulic cylinder 9 is connected to the inner member 3 with a pin 10 and the bottom side of the first hydraulic cylinder 9 is connected to the second member 5 with a pin 11.

Figure 13:
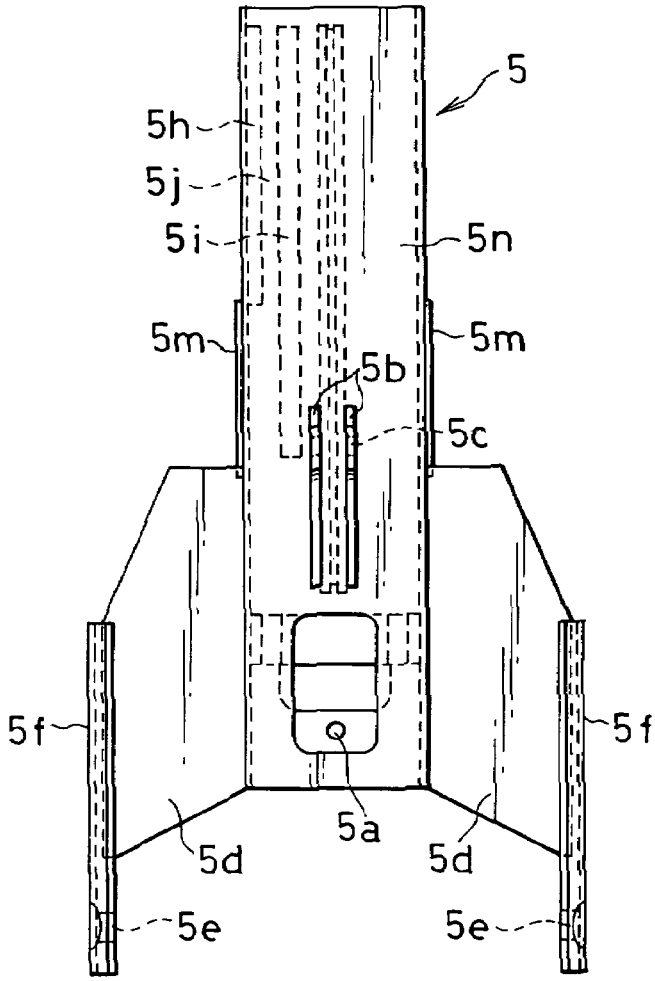
FIG. 13 is a front view of the second member achieved in the embodiment.
Figure 15:
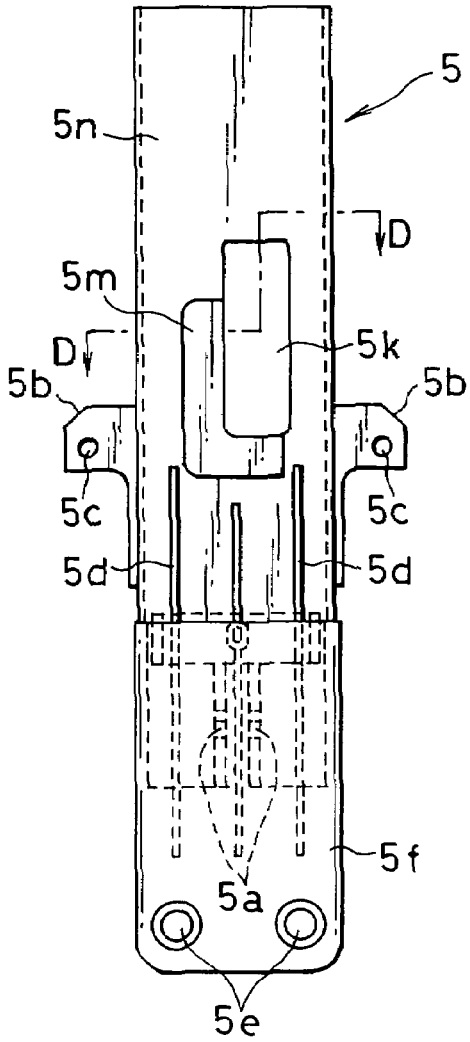
FIG. 15 is a side elevation of the second member achieved in the embodiment.
Figure 14:
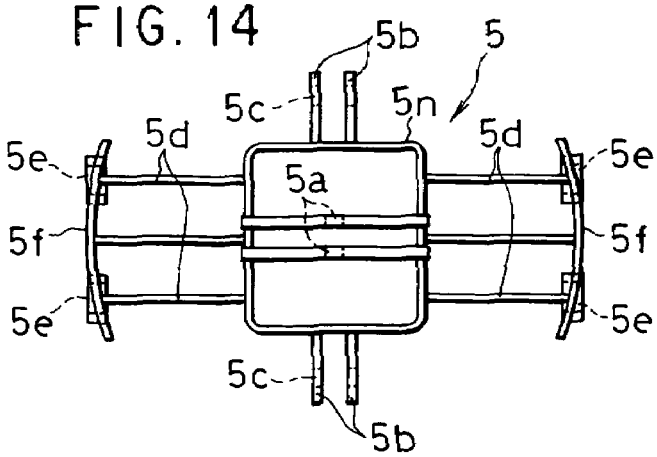
FIG. 14 is a bottom view of the second member in FIG. 13.
Figure 16:
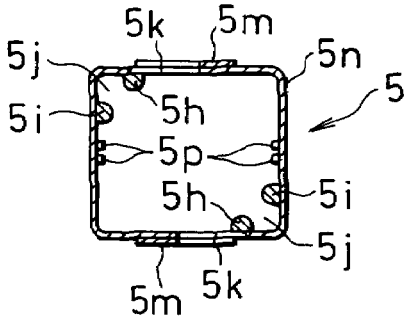
FIG. 16 is a sectional view taken along D—D in FIG. 15.

FIG. 13 is a front view of the second member 5, FIG. 14 is a bottom view of the second member 5, FIG. 15 is a side elevation of the second member 5 and FIG. 16 is a plan view of the second member 5. In FIGS. 13 to 15, reference numeral **5*n* indicates an angular tube portion provided at the center of the second member 5, which is fitted inside the angular tube portion 6*i* of the outer member 6 so as to be allowed to move up/down without allowing the angular tube portions 6*i* to rotate relative to each other. Reference numeral 5*a* indicates a pin hole formed at the second member 5 at which the pin 11 is inserted. As the inner member 3 is lifted together with the kelly bar 1, the first hydraulic cylinder 9 extends by stretching relative to the second member 5 and, as a result, pressure oil is supplied to second hydraulic cylinders 12 provided to grab the grab bucket 8**.

The second hydraulic cylinders 12 are mounted at brackets 5*b* (see FIGS. 13 to 15) provided to the front and to the rear of the angular tube portion 5*n* of the second member 5 and at brackets 6*j* (see FIG. 12) provided at the cylindrical bucket mounting parallel plates 6*a* located to the front and to the rear of the outer member 6 via pins 13 and 14 respectively. Reference numeral 5*c* in FIGS. 13 to 15 and reference numeral 6*c* in FIGS. 8 and 12 respectively indicate pin holes at which the pins 13 and 14 are inserted.

As shown in FIGS. 13 to 15, mounting plates 5*d* are bonded to the left and right sides of the angular tube portion 5*n* at the second member 5. Brackets 5*f* are mounted at the front ends of these mounting plates 5*a[1]. Each bracket 5***f* includes pin hole 5*e* through which a pin 15 (see FIGS. 2 and 3) is inserted to rotatably connect a pivotal connecting portion located on the upper inner side of a jaw 8*a* of the grab bucket 8.

As shown in FIGS. 2 and 3, each bracket 6*b* at the outer member 6 and the central portion of the corresponding jaw 8*a* are rotatably linked via links 16 and pins 17 and 19. Reference numeral 6*d* in FIGS. 8, 9 and 12 indicates a pin hole through which the pin 17 is inserted.

As shown in FIG. 7, third hydraulic cylinders 20 are provided on one side of the hydraulic circuit between the first hydraulic cylinders 9 and the second hydraulic cylinders 12. The third hydraulic cylinders 20 constitute a dummy hydraulic cylinder having the function of matching the supply/discharge oil quantities between the hydraulic cylinders 9 and 12. The presence of such third hydraulic cylinders 20 eliminates the need to mount an accumulator and the like at the excavating tool. In addition, since a structure having the piston rod side of the first hydraulic cylinder 9 turned upward and the bottom chambers of the second hydraulic cylinders 12 turned upward can be adopted, a closed hydraulic circuit can be formed with hydraulic piping constituted of steel instead of hydraulic hose. As shown in FIGS. 2, 4, 5, 8, 9 and 11, the third hydraulic cylinders 20 are mounted by pinning their upper ends to brackets 6*h* provided at ribs 6*e* constituted of parallel plates at the outer member 6.

Figure 17:
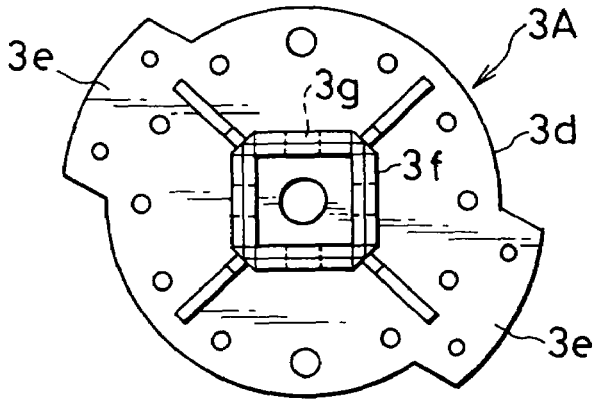
FIG. 17 is a plan view of the first member constituting the inner member achieved in the embodiment.
Figure 18:
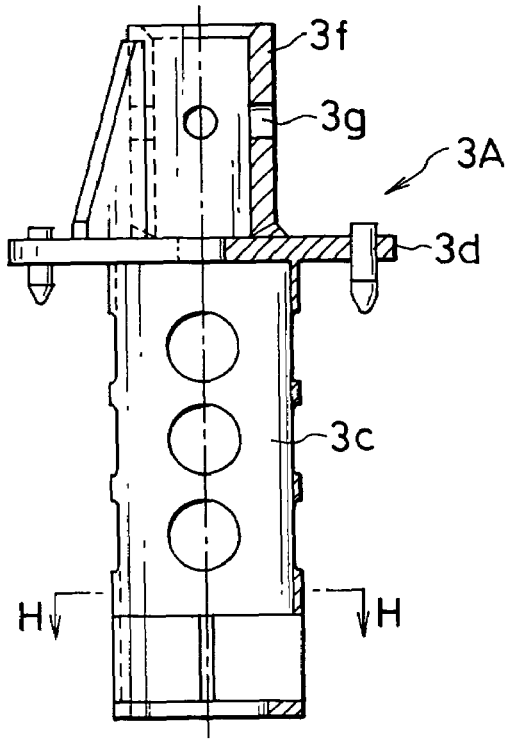
FIG. 18 is a cutaway side elevation of the first member shown in FIG. 17.
Figure 19:
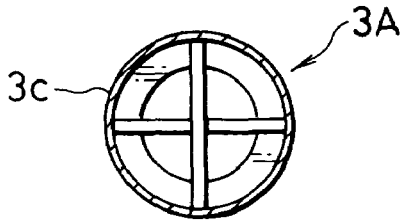
FIG. 19 is a sectional view taken along H—H in FIG. 18.

As shown in FIG. 6, the inner member 3 is constituted of a first member 3A and a second member 3B. FIGS. 17 through 19 shows the first member 3A which includes a locking element 3*d* assuming the shape of a disk larger than a cylindrical portion 3*c* and located above the cylindrical portion 3*c*. The locking element 3*d* includes a plurality of projecting portions 3*e* projecting outward and formed along the outer circumference. The first member 3A also includes a connecting portion 3*f* assuming an angular tube shape, which connects with the kelly bar 1 and is located above the locking element 3*d*, and a pin hole 3*g* through which the pin 4 is inserted to mount the first member 3A at the kelly bar 1 is formed at the connecting portion 3*f*.

Figure 20:
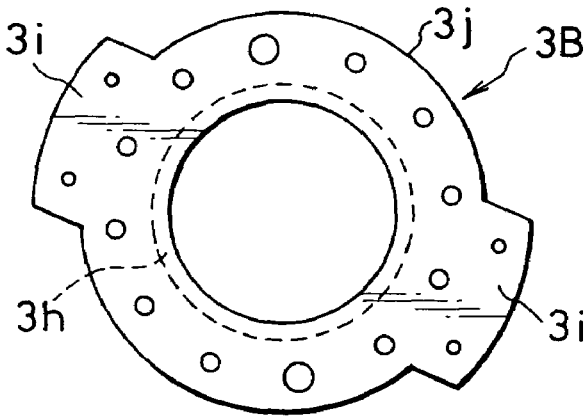
FIG. 20 is a plan view of the second member constituting the inner member in the embodiment.
Figure 21:
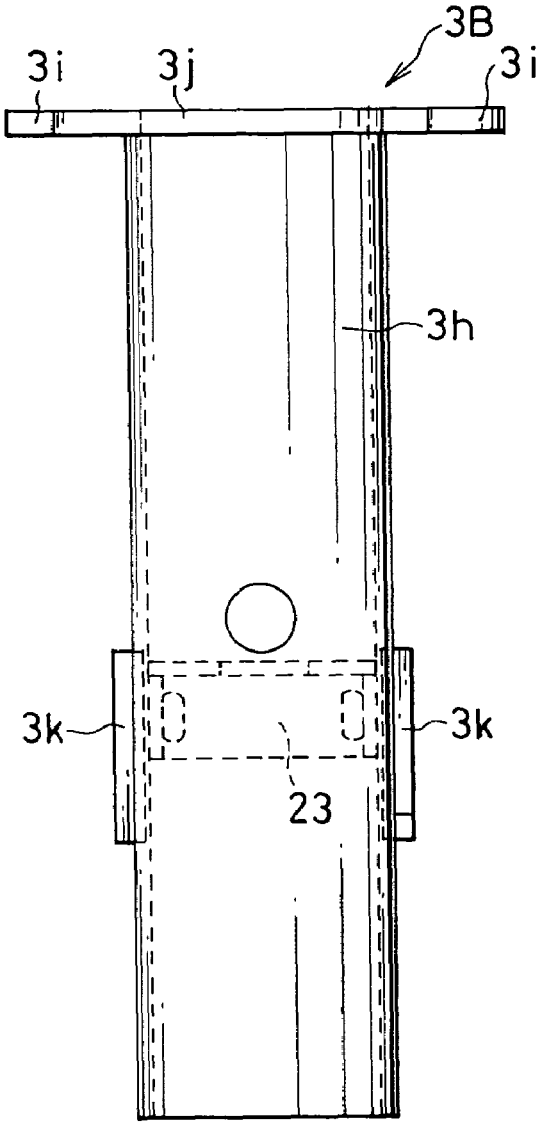
FIG. 21 is a side elevation of the second member shown in FIG. 20.
Figure 22:
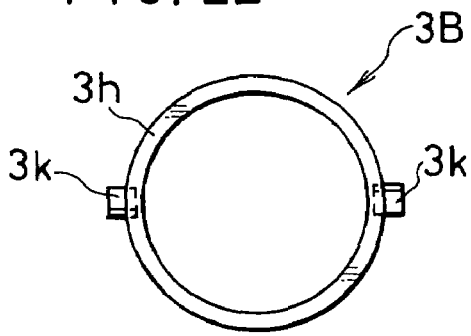
FIG. 22 is a bottom view of FIG. 20.

FIGS. 20 through 22 show the second member 3B which includes a locking element 3*j* isomorphic with the locking element 3*d*, having projecting portions 3*i* similar to those of the locking element 3*d*, assuming the shape of a disk with an area larger than the area of a cylindrical portion 3*h* and located at the top of the cylindrical portion 3*h*. In addition, inside the cylindrical portion 3*h*, a cylindrical element 23, which supports a connecting piece 22 of the pin 10 at the first hydraulic cylinder 9 is fastened. As shown in FIGS. 3 and 6, the first member 3A and the second member 3B are fastened to each other with a fastening piece 24 by fitting their cylindrical portions 3*c* and 3*h* with each other. In addition, as shown in FIGS. 2 through 5, the locking elements 3*d* and 3*j* are fastened to each other with a fastening piece 25 by placing each projecting portion 3*e* in alignment with a projecting portion 3*i*.

Figure 23:
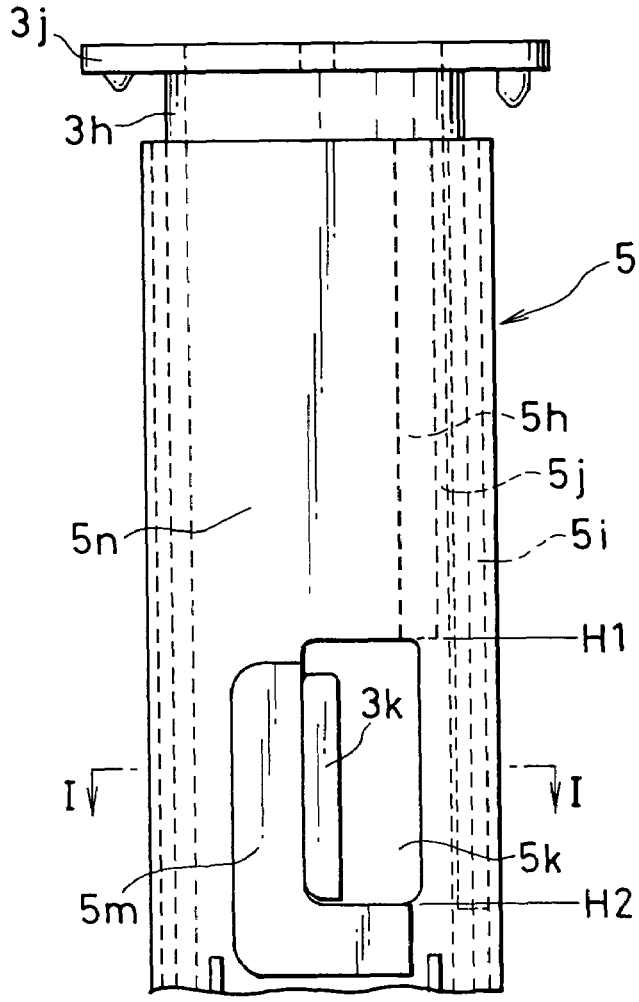
FIG. 23 is a side elevation of a structure that allows the inner member and the second member to be set in combination with each other during a forward rotation when the excavating tool in the embodiment is in the most contracted state.
Figure 24:
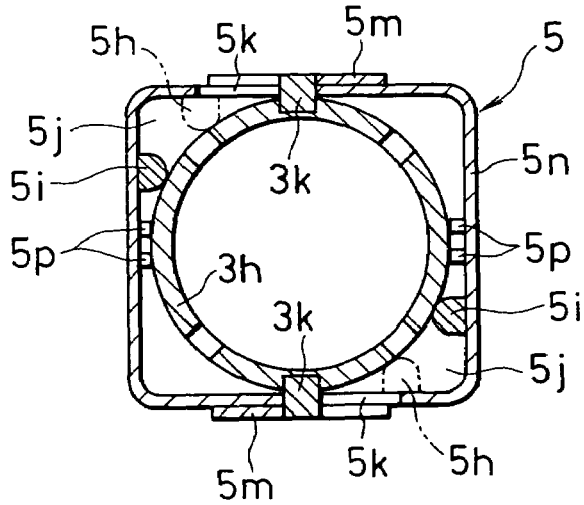
FIG. 24 is a sectional view taken along I—I in FIG. 23.

As shown in FIGS. 21 and 22, at the bottom of the second member 3B, projections 3*k* are provided at two positions facing opposite each other. As shown in FIGS. 23 and 24, at the angular tube portion 5*n* of the second member 5, guide rails 5*j* extending along the longitudinal direction and each constituted of two rods 5*h* and 5*i* are provided in two corners facing opposite each other. In addition, at the inner surface of the angular tube portion 5*n* of the second member 5, bracing rails 5*p* which, together with the guide rails 5*j*, come in contact with the outer circumferential surface of the cylindrical portion 3*h* of the inner member 3 are provided. At two side surfaces of the second member 5 facing opposite each other, openings 5*k* at which the projections 3*k* are fitted are provided, with stoppers 5*m* provided along the edges of the openings 5*k*. As shown in FIG. 23, of the two rods 5*h* and 5*i* constituting guide rails 5*j*, the lower end of the rod 5*h* located closer to the opening 5*k* is set at a height H1 substantially level with the upper side of the opening 5*k*, whereas the lower end of the rod 5*i* located further away from the opening 5*k* is set at a height H2 substantially level with the lower side of the opening 5*k*.

As shown in FIGS. 4, 5 and 10, at the top of the outer member 6, a locking element bearing plate 6*f*constituted of a plate having a locking element passing portion 6*g*substantially isomorphic with the locking elements 3*g* and 3*j* of the inner member and slightly larger than the locking elements 3*d* and 3*j* is provided. The locking element passing portion 6*g*includes dented portions 6*j* (may be grooves) in correspondence to the projecting portions 3*e* and 3*i* mentioned earlier. When the projections 3*k* of the inner member 3 fitted at the guide rails 5*j*, the projecting portions 3*e* and 3*i* of the locking elements 3*d* and 3*j* are set at positions corresponding to the positions of the dented portions 6*j* of the locking element passing portion 6*g*, as shown in FIG. 5, and thus, the locking elements 3*d* and 3*j* are allowed to pass through the locking element passing portion 6*g*. Since the outer circumferential surface of the cylindrical portion 3*h* of the inner member 3 is placed in contact with the guide rails 5*j* and the bracing rails 5*p*, the inner member 3 does not become off-centered relative to the second member 5 and the outer member 6, and as a result, the locking elements 3*d* and 3*j* are allowed to pass through the locking element passing portion 6*g*smoothly without play.

When the inner member 3 is at the lowest position relative to the outer member 6, i.e., when the excavating tool is in the most contracted state, the projections 3*k* of the inner member 3 are set lower than the bottom ends of the rods 5*h*, as shown in FIG. 23, and thus, as the inner member 3 is caused to rotate forward together with the kelly bar 1 (as the inner member 3 rotates along the excavating direction), the inner member 3 rotates forward relative to the second member 5 and the outer member 6, thereby allowing the projections 3*k* to slip out of the openings 5*k* to come in contact with the stoppers 5*m*. As the inner member 3 is made to rotate forward in this manner, the projecting portions 3*e* and 3*i* of the locking elements 3*d* and 3*j* become locked at the locking element bearing plate 6*f* as shown in FIG. 4, and thus, the outer member 6 can be lifted together with the inner member 3 by lifting the kelly bar 1. By constituting the locking elements 3*d* and 3*j* and the locking element bearing plate 6*f*with plates larger in size than the cylindrical portions 3*c* and 3*h* in the structure, the locking elements 3*d* and 3*j* locked at the locking element bearing plate 6*f*are allowed to achieve contact with the locking element bearing plate 6*f*over large areas so as to withstand a large load.

Next, the operation of the excavating tool is explained. After the soil is discharged overground, the grab bucket 8 is in an open state, and as the kelly bar 1 is rotated forward with the cylindrical bucket 7 set on the ground in this state, the locking elements 3*d* and 3*j* become locked at the locking element bearing plate 6*f* as shown in FIG. 4. The excavating tool 2 is then hoisted into the bore hole 30 (see FIG. 1).

As the cylindrical bucket 7 of the excavating tool 2 is set onto the bottom surface of the bore hole 30, the kelly drive device 56 is activated to rotate the excavating tool 2 along the forward direction via the kelly bar 1. As a result, the projections 3*k* of the inner member 3 come into contact with the stoppers 5*m* of the second member 5. In addition, the projecting portions 3*e* and 3*i* of the locking. elements 3*d* and 3*j* become locked at the locking element bearing plate 6*f*of the outer member 6. The rotational force of the kelly bar 1 is communicated to the cylindrical bucket 7 in this state, thereby causing the cylindrical bucket 7 to rotate and allowing the cylindrical bucket 7 to excavate a slab, cobblestones or boulders.

Such an excavating operation can be executed with a load smaller than the load of the excavating tool 2 applied to the excavating surface by operating the hoist winch 57 slightly along the lifting direction to apply a slight force to the kelly bar 1 along the lifting direction and thus rotating the kelly bar 1 along the forward direction, i.e., along the excavating direction. As a result, even when the excavating operation is executed by rotationally driving a relatively large excavating tool 2 with a small earth drill, the operation can be executed with a small pressing force. Thus, a sufficient drive force is assured in the excavating operation. In addition, even if there is an excessively large excavating reactive force, the excavating operation can be executed with an optimal pressing force. It goes without saying that depending upon the situation, the excavating operation can be executed with a pressing force equal to or greater than the load of the excavating tool 2 and the like by holding the kelly bar 1 downward with a pressing device (not shown) provided at the kelly drive device 56.

As the excavating operation executed with the cylindrical bucket 7 progresses and excavated material is collected in the cylindrical bucket 7 in a quantity suitable to be taken into the grab bucket 8, the inner member 3 is rotated in reverse together with the kelly bar 1. This reverse rotation places the projections 3*k* of the inner member 3 each in contact with one of the rods, i.e., the 5 rod 5*i* constituting a guide rail 5*j*, as shown in FIGS. 25 and 26.

Figure 25:
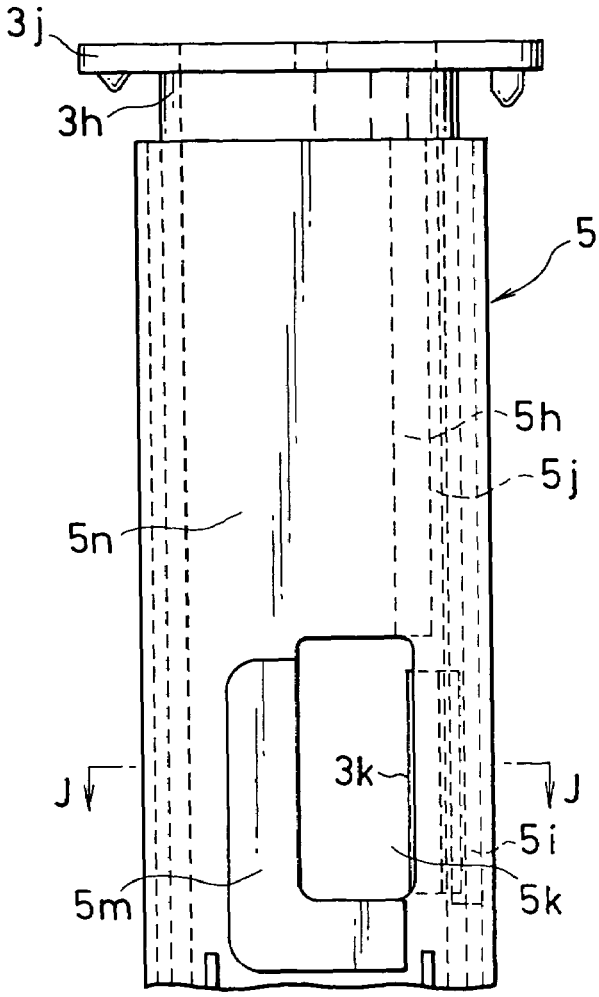
FIG. 25 is a side elevation of a structure that allows the inner member and the second member to be set in combination with each other during a reverse rotation when the excavating tool in the embodiment is in the most contracted state.
Figure 26:
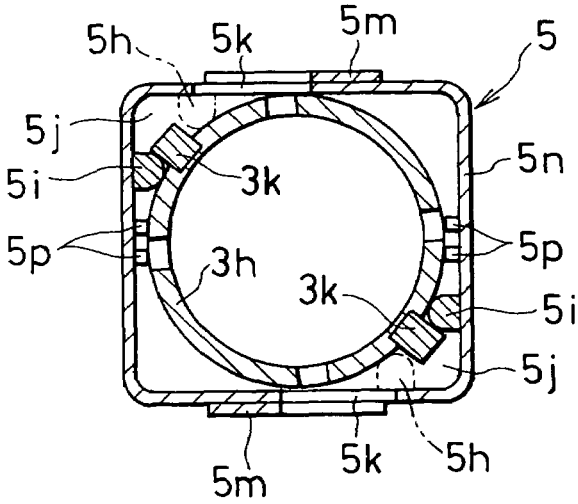
FIG. 26 is a sectional view taken along J—J in FIG. 25.

Then, the inner member 3 is lifted together with the kelly bar 1 in the state shown in FIGS. 25 and 26. In this situation, since the loads of the outer member 6, the cylindrical bucket 7 and the grab bucket 8 are applied to the second member 5, the first hydraulic cylinder 9 is first allowed to extend. As the first hydraulic cylinder 9 extends as described above, the oil in a rod chamber a of the first hydraulic cylinder 9 becomes pressurized to become pressure oil which then enters bottom chambers b at the tops of the second hydraulic cylinders 12, as indicated by the arrows in FIG. 7. In addition, the oil in rod chambers c of the second hydraulic cylinders 12 enters rod chambers d of the third hydraulic cylinders 20, whereas the oil in the bottom chambers e of the third hydraulic cylinders 20 enters a bottom chamber f of the first hydraulic cylinder 9.

As the oil flows as described above, the second hydraulic cylinders 12 extend, which causes the second member 5 to move upward. As a result, the opposite ends of the jaws 8*a* connected via the pins 15 with the brackets 5*f* fastened to the second member 5 become lifted, thereby closing the grab bucket 8, as shown in FIG. 3 to allow it to grab the excavated material. It is to be noted that if a slab is being excavated, the grab bucket 8 grabs the slab drilled in a disk shape at its edge, and thus, the grab bucket 8 does not close as completely.

As described above, the force with which the kelly bar 1 is lifted can be used to close the grab bucket 8 and, as a result, a high level of closing force can be obtained by using the hoisting force of the hoist winch 57.

In this structure, the second hydraulic cylinders 12 and the third hydraulic cylinders 20 function as a booster that compensates for the difference between the supply and discharge quantities of oil attributable to the difference in the sectional areas of the rod chamber a and the bottom chamber f of the first hydraulic cylinder 9. Thus, a closed circuit can be constituted without having to employ an accumulator.

After the excavated material is grabbed in the grab bucket 8 as described above, the kelly bar 1 is lifted together with the excavating tool 2 by the hoist winch 57. After the excavating tool 2 having been lifted to the ground level is set on the ground surface, the kelly bar 1 is lowered to allow the oil to flow in the direction opposite from that indicated by the arrows in FIG. 7, thereby causing the first hydraulic cylinder 9 to contract, as shown in FIG. 2. As a result, the second hydraulic cylinders 12 also contract to open the grab bucket 8 to discharge the excavated material in the grab bucket 8.

During the operation described above, if the lifting reactive force generated at the bottom of the bore hole is too large relative to the force applied to close the grab bucket 8, the grab bucket 8 can be lifted in an open state by lowering the inner member 3 again, rotating the kelly bar forward by a specific angle and locking the locking elements 3*d* and 3*j* at the locking element bearing plate 6*f*. Thus, the excavating tool can be lifted from underground even under such circumstances.

Figure 27:
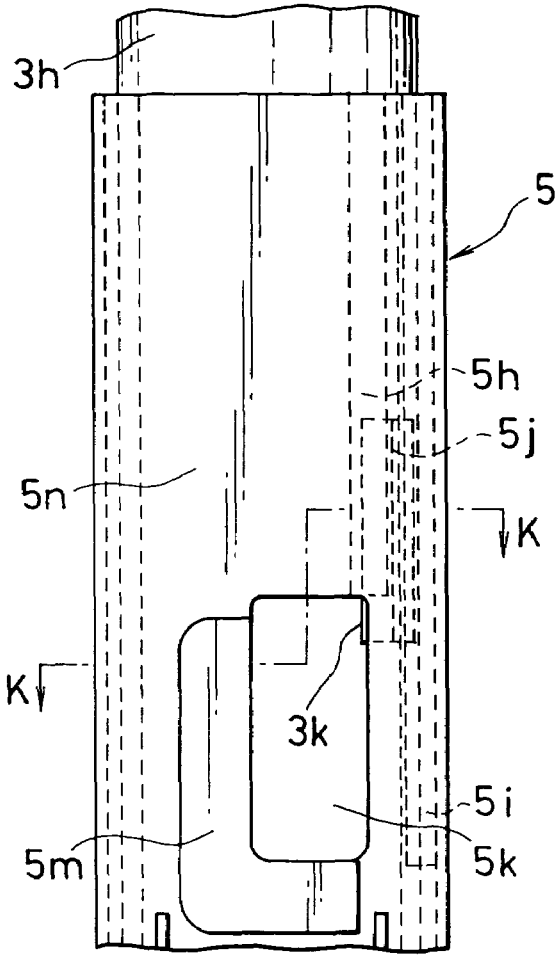
FIG. 27 is a side elevation of a structure that allows the inner member and the second member to be set in combination with each other when the grab bucket is in a half closed state in the excavating tool in the embodiment.
Figure 28:
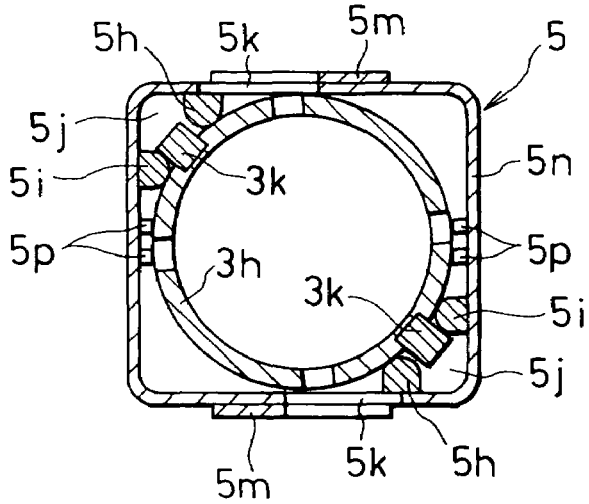
FIG. 28 is a sectional view taken along K—K in FIG. 27.

Also, as shown in FIGS. 27 and 28, when the inner member 3 is lifted to a certain extent relative to the second member 5 and the outer member 6, i.e., when the grab bucket 8 is undergoing the process of becoming closed, the projections 3*k* of the inner member 3 are clamped between the rods 5*h* and 5*i* of the guide rails 5*j*. If the inner member 3 is rotated together with the kelly bar 1 in this state, the second member 5 and the outer member 6, too, can be rotated forward and back by interlocking with the rotation of the inner member 3. Thus, by rotating them while an underground obstacle is held in the grab bucket 8, the underground obstacle can be handled with greater ease than in the related art.

The present invention may also be adopted in a structure having a cylindrical add-on excavating tool with cutting teeth, which is detachably mounted at the lower end of the cylindrical bucket 7 with a fastening piece such as a bolt, as described in Japanese Unexamined Patent Publication No. 2001-90465. By adopting the structure, it becomes possible to execute the excavating operation in an optimal manner at all times by selecting an excavating tool having an optimal depth and an optimal function for a given excavating site from various add-on excavating tools with varying heights and varying types of cutting teeth.

In addition, the present invention may be implemented without the third hydraulic cylinders 20 by, for instance, reversing the top side and the bottom side of the second hydraulic cylinders 12. Also, the present invention may be adopted in an earth drill having a structure in which the kelly drive device is moved up/down along a leader. Moreover, the inner member 3 may have a single cylinder structure instead of the double cylinder structure.

INDUSTRIAL APPLICABILITY

The excavating tool for an earth drill according to the present invention, having a grab bucket provided inside a cylindrical bucket and the grab bucket is caused to close by the force with which the kelly bar is lifted, allows the locking elements of the inner member to be locked at the locking element bearing plate of the outer member while the excavating tool is in its most contracted state. As a result, an excavating operation can be executed while a load smaller than the load of the excavating tool is applied. Thus, an earth drill with a small drive force is able to perform an excavating operation with a relatively large bucket. In addition, whenever the situation calls for it, an ideal excavating operation can be executed with a small pressing force. Since it adopts the structure having the guide rails at the second member at which the projections formed at the outer circumference of the inner member become held so as to be allowed to move up/down freely, it is possible to rotate the grab bucket while it is closed to a certain extent, and consequently, underground obstacles can be removed with ease in a manner appropriate to a given situation.

The invention claimed is:

1. An excavating tool for an earth drill, characterized by comprising:

a tubular inner member connected to a kelly bar, a tubular second member fitted on the outer side of said inner member so as to be allowed to move up/down freely and an outer member fitted on the outer side of said second member so as to be allowed to move up/down freely;

a cylindrical bucket and a grab bucket housed inside said cylindrical bucket mounted to said outer member;

a first hydraulic cylinder mounted between said inner member and said second member, and second hydraulic cylinders which extend/contract by the pressure oil from said first hydraulic cylinder mounted between said second member and jaws of said grab bucket;

a locking mechanism provided between said inner member and said outer member, said locking mechanism being constituted of locking elements provided at the outer circumference of said inner member and a locking element bearing plate provided at the upper portion of said outer member, said locking elements being allowed to pass through said locking element bearing plate when said inner member and said outer member achieve a specific relative rotational angle and said locking elements become locked at said locking element bearing plate to disallow relative vertical movement of said inner member and said outer member, by rotating said inner member forward when said excavating tool is in a most contracted state; and projections provided at the outer circumference of said inner member fitted at guide rails extending along the longitudinal direction at the inner circumference of said second member so as to be allowed to move up/down freely, and said inner member is allowed to rotate forward relative to said second member within a predetermined range when said excavating tool is in the most contracted state; and wherein said inner member includes said locking elements above cylindrical portions;

said locking elements respectively include projecting portions projecting outward as integrated portions of disks having diameters larger than the diameters of said cylindrical portions; and said locking element bearing plate is constituted of a plate having a locking element passing portion substantially isomorphic with said locking elements and slightly larger than said locking elements.

2. An excavating tool for an earth drill according to claim 1, characterized in that:

said inner member includes a cylindrical portion; and the outer circumferential surface of said cylindrical portion is in contact with said guide rails provided at corners of an angular tube portion inside said second member and bracing rails provided at the inner surface of said angular tube portion.

3. An excavating tool for an earth drill according to claim 1, characterized in that:

third hydraulic cylinders that match supply/discharge oil quantities between said first hydraulic cylinder and said second hydraulic cylinders are provided in a closed hydraulic circuit located between said first hydraulic cylinder and said second hydraulic cylinders.

4. An excavating tool for an earth drill according to claim 2, characterized in that:

third hydraulic cylinders that match supply/discharge oil quantities between said first hydraulic cylinder and said second hydraulic cylinders are provided in a closed hydraulic circuit located between said first hydraulic cylinder and said second hydraulic cylinders.

* * * * *